United States Patent [19]

Mahoney

[11] Patent Number: 4,743,171

[45] Date of Patent: May 10, 1988

[54] MARINE INSTALLATION INCLUDING FUEL/OIL MIXING DEVICE

[75] Inventor: J. Michael Mahoney, Briston, Wis.

[73] Assignee: Outboard Marine Corporation, Waukegan, Ill.

[21] Appl. No.: 921,223

[22] Filed: Oct. 20, 1986

[51] Int. Cl.[4] ..... F02B 33/02

[52] U.S. Cl. ..... 417/349; 417/480; 417/505; 91/224; 123/73 AD

[58] Field of Search ..... 417/480, 505, 349; 91/275, 224; 123/73 AD; 251/65

[56] References Cited

U.S. PATENT DOCUMENTS

| | | | |
|---|---|---|---|
| 2,661,726 | 12/1953 | Alfieri | 91/229 X |
| 2,862,478 | 12/1958 | Staats | 91/229 X |
| 2,960,971 | 11/1960 | Tear | 91/275 |
| 3,013,531 | 12/1961 | Mueller et al. | 91/275 |
| 3,192,865 | 7/1965 | Klempay | 91/275 X |
| 3,216,328 | 11/1965 | Peterson | 91/275 X |
| 3,216,329 | 11/1965 | Peterson | 91/275 X |
| 3,253,514 | 5/1966 | Peterson | 91/275 X |
| 3,299,826 | 6/1967 | Williams | 91/275 X |
| 3,481,578 | 12/1969 | Baldi | 251/65 |
| 3,605,556 | 9/1971 | Erdmann | 91/229 X |
| 4,276,001 | 6/1981 | Holmes | 417/401 |
| 4,471,728 | 9/1984 | Borst et al. | 123/73 AD |
| 4,555,221 | 11/1985 | Dubois | 123/73 AD |
| 4,594,970 | 6/1986 | Baars et al. | 123/73 AD |

*Primary Examiner*—Leonard E. Smith

*Attorney, Agent, or Firm*—Michael, Best & Friedrich

[57] ABSTRACT

An apparatus comprising a housing, a wall dividing the housing into high and low pressure chambers having a pressure differential therebetween, the wall including a surface partially defining the high pressure chamber, and a passage communicating with the surface and between the high and low pressure chambers, a valve seat located on the surface adjacent the passage, a valve member movable into engagement with the valve seat for preventing fluid flow through the passage, and a mechanism for causing the valve member to move away from the valve seat with a snap action.

25 Claims, 3 Drawing Sheets

MARINE INSTALLATION INCLUDING FUEL/OIL MIXING DEVICE

BACKGROUND OF THE INVENTION

The invention relates generally to means for feeding a fuel/oil mixture to an internal combustion engine and particularly to means for feeding a fuel/oil mixture to the carburetor of a marine propulsion device such as an outboard motor or a stern drive unit.

Still more particularly, the invention relates to portable fuel tanks and to means for pumping oil and fuel from a remote portable or fixed fuel tank to a marine propulsion device.

The invention also relates to valve assemblies, and, more particularly, to means for moving a valve member out of engagement with a valve seat.

Attention is directed to the following prior art U.S. Pats. Nos.:

Erdmann, 3,605,556, Sept. 20, 1971
Staats, 2,862,478, Dec. 2, 1958
Alfieri, 2,661,726, Dec. 8, 1953
Borst, 4,471,728, Sept. 18, 1984.

Attention is also directed to U.S. Pat. No. 4,594,970, issued June 17, 1986, to Baars and assigned to the assignee of this application.

SUMMARY OF THE INVENTION

The invention provides an oil storing, oil pumping and, and fuel/oil mixing assembly comprising an upper wall having therein an opening which is adapted to afford filling of oil into the device, an endless wall depending from the upper wall to partially define an oil reservoir communicating with the opening, and an oil pumping and fuel/oil mixing device secured to the depending wall to form the bottom of the oil reservoir. The device includes a housing, and a movable wall dividing the housing into inlet and outlet chambers adapted to have a pressure differential therebetween, the wall having therethrough a passage communicating between the inlet and outlet chambers. The device further includes a first inlet communicating between the inlet chamber and the oil reservoir, a second inlet communicating with the inlet chamber and adapted to communicate with a fuel source, an outlet communicating with the outlet chamber for delivering the fuel/oil mixture, a valve seat adjacent the passage, a valve member movable along an axis in a first direction and toward the valve seat to a seated position for preventing fluid flow through the passage, the valve member also being movable in an opposite second direction and away from the valve seat to an unseated position for permitting fluid flow through the passage, and means for moving the valve member away from the valve seat with a snap action and including a magnet located, relative to the valve member, in the first direction, the magnet being movable along the axis and relative to the valve member between a first position and a second position spaced in the second direction from the first position, means for exerting on the magnet, when the valve member is seated, a magnetic force biasing the magnet in the first direction and to the first position, means for preventing movement of the magnet in the second direction beyond the second position, means for exerting on the magnet a second force biasing the magnet in the second direction, and means for increasing the second force, when the valve member is seated, until the second force is greater than the magnetic force.

In one embodiment, the housing includes an inlet side member and an outlet side member, and the movable wall is located between the inlet side member and the outlet side member.

In one embodiment, the means for exerting a second force includes spring means having a variable deflection, and the increasing means includes means for increasing the deflection of the spring means.

In one embodiment, the wall is movable within the housing for varying the volumes of the inlet and outlet chambers, movement of the wall in the first direction decreases the volume of the outlet chamber, and the spring means includes a compression spring extending between the housing and the valve member in the outlet chamber, the spring being compressed in response to movement of the wall in the first direction.

In one embodiment, the pressure differential between the inlet and outlet chambers creates a force biasing the wall in the first direction, and the means for increasing the deflection of the spring means includes the pressure differential.

In one embodiment, the means for exerting the magnetic force includes a magnetically attractive member mounted on the wall.

In one embodiment, the means for preventing movement includes the valve member.

In one embodiment, the pressure differential between the inlet and outlet chambers biases the valve member in the first direction.

In one embodiment, the wall includes a surface, the passage communicates with the surface through an opening, and the valve seat is located on the surface around the opening.

The invention also provides a valve assembly comprising a wall having therein a passage, a valve seat adjacent the passage, a valve member movable along an axis in a first direction and toward the valve seat to a seated position for preventing fluid flow through the passage, the valve member also being movable in an opposite second direction and away from the valve seat to an unseated position for permitting fluid flow through the passage, and means for moving the valve member away from the valve seat with a snap action and including a magnet located, relative to the valve member, in the first direction, the magnet being movable along the axis and relative to the valve member between a first position and a second position spaced in the second direction from the first position, means for exerting on the magnet, when the valve member is seated, a magnetic force biasing the magnet in the first direction and to the first position, means for preventing movement of the magnet in the second direction beyond the second position, means for exerting on the magnet a second force biasing the magnet in the second direction, and means for increasing the second force, when the valve member is seated, until the second force is greater than the magnetic force.

The invention also provides an apparatus comprising a housing, a wall dividing the housing into high and low pressure chambers adapted to have a pressure differential therebetween, the wall having therethrough a passage communicating between the high and low pressure chambers, a valve seat adjacent the passage, a valve member movable along an axis in a first direction and toward the valve seat to a seated position for preventing fluid flow through the passage, the valve member also being movable in an opposite second direction and away from the valve seat to an unseated position for permitting fluid flow through the passage, and means for moving the valve member away from the valve seat with a snap action and including a magnet located, relative to the valve member, in the first direction, the magnet being movable along the axis and relative to the valve member between a first position and a second position spaced in the second direction from the first position, means for exerting on the magnet, when the valve member is seated, a magnetic force biasing the magnet in the first direction and to the first position, means for preventing movement of the magnet in the second direction beyond the second position, means for exerting on the magnet a second force biasing the magnet in the second direction, and means for increasing the second force, when the valve member is seated, until the second force is greater than the magnetic force.

Other features and advantages of the embodiments of the invention will become known by reference to the following general description, claims and appended drawings.

IN THE DRAWINGS

Figure 1:
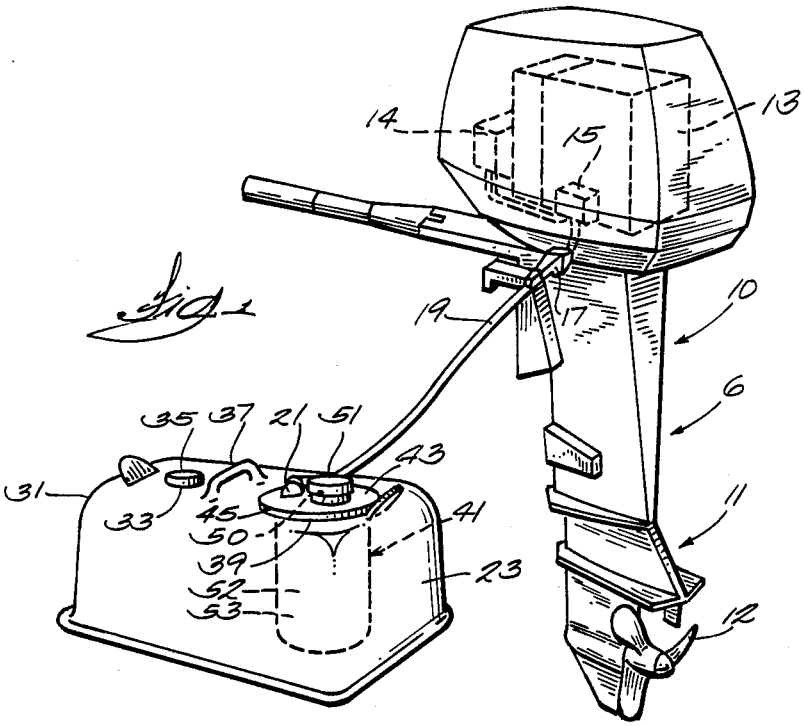
FIG. 1 is a perspective view of a marine propulsion installation which embodies various of the features of the invention and which includes a combined oil reservoir, oil pump and fuel/oil mixing device.

Before one embodiment of the invention is explained in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a conventional outboard motor 10 which includes a lower unit 11 supporting a propeller 12, and a powerhead including a two-stroke internal combustion engine 13. The engine 13 is operated on a suitable fuel/oil mixture and includes fuel feeding means in the form of a carburetor 14 which can be of conventional construction and which receives the fuel/oil mixture from a fuel/oil mixture pump 15 which is commonly powered by pulsating crankcase pressure. In turn, the fuel/oil mixture pump 15 communicates with a fitting 17 adapted to be releasably connected to a flexible fuel/oil mixture hose or line 19 which, in turn, at its outer end, includes a fitting which, in the past, has been adapted to be releasably connected to a fitting on a remote portable fuel tank into which both fuel and oil have been supplied and mixed. The fuel/oil mixture pump 15 has conventionally created sufficient pressure to lift the mixture from the fuel tank under normal circumstances when the fuel tank was located not too distantly from the outboard motor.

Figure 2:
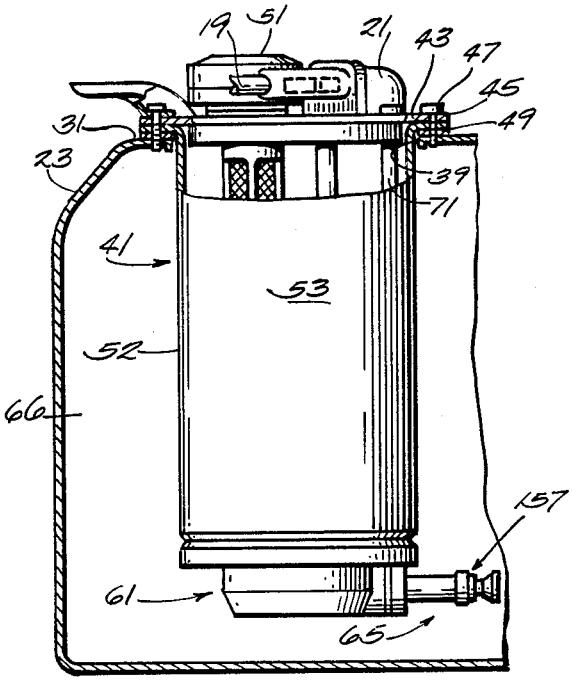
FIG. 2 is an enlarged view, partially broken away and in section, of the combined oil reservoir, oil pump and fuel/oil mixing device.

Because of the desirability of insuring a proper ratio between the fuel and oil for a particular outboard motor and because of the economy of purchasing fuel and oil separately, as distinguished from "premix", the fuel line 19 is releasably connected to a fitting 21 on a tank 23 which embodies various of the features of the invention and which, as shown more fully in FIG. 2, includes separate reservoirs or compartments for each of fuel and oil, together with an oil pumping and fuel/oil mixing apparatus which is actuated by the suction of the fuel/oil pump 15 and which pumps oil into the outgoing fuel in the proper ratio which is "built-in". This apparatus is disclosed in part by Baars U.S. Pat. No. 4,594,970, issued June 17, 1986, which is assigned to the assignee hereof, and which is incorporated herein by reference.

More particularly, the tank 23 comprises a combined device for separately storing fuel and oil, and for pumping oil, and for supplying a fuel/oil mixture for operating the outboard motor 10. The tank 23 is constructed of metal and includes, in addition to bottom and side walls, a top wall 31 having a fuel filling or supply opening 33 which communicates with the interior of the tank and which is fabricated to removably receive a covering cap 35 having a closeable vent opening (not shown).

In addition, the top wall 31 of the tank 23 supports a handle 37 which is welded or otherwise attached thereto, and includes a somewhat larger second opening 39 which is generally circular and which is located on the other side of the handle 37 from the fuel supply opening 33.

The larger or second opening 39 is closed by an oil storing, oil pumping, and fuel/oil mixing assembly 41. This assembly includes an upper wall 43 having an outer periphery which is secured, as by suitable screws 47 and a gasket 49 (see FIG. 2), to the margin around the periphery of the larger generally circular opening 39 in the top wall 31 of the portable tank 23. The upper wall 23 includes (see FIG. 1) an oil filling or supply opening 50 which is configured to receive a covering cap 51 which can include a small vent opening (not shown).

Extending downwardly from the upper wall 43 is circular or endless depending wall 52 which partially defines an oil reservoir 53. The bottom of the oil reservoir 53 is provided by a combined oil pumping and fuel/oil mixing device 61 which is suitably attached to the bottom of the depending wall 52, as for instance by screws or by crimping the bottom margin of the depending wall 52 around the circular periphery of the combined oil pumping and fuel/oil mixing device 61.

Figure 7:
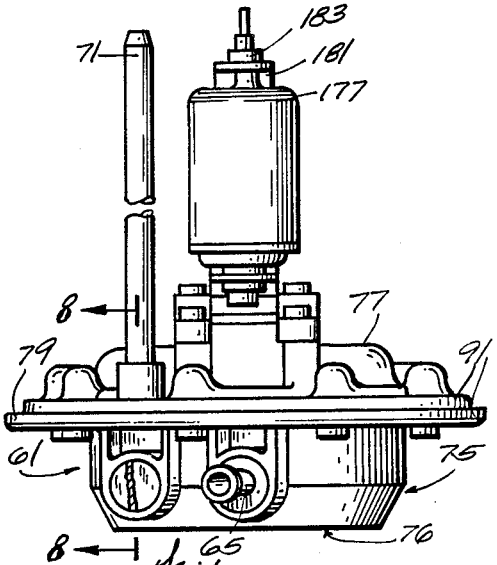
FIG. 7 is a side elevational view of the combined oil reservoir, oil pump, and fuel/oil mixing device shown in FIG. 3.
Figure 8:
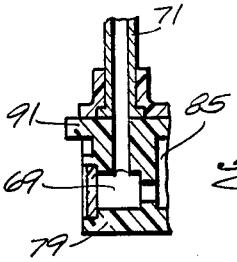
FIG. 8 is a sectional view taken along line 8—8 of FIG. 7.

The combined oil pumping and fuel/oil mixing device 61 includes (see FIG. 3) an oil inlet 63 which extends into and communicates with the oil reservoir 53, a fuel inlet 65 which communicates with the interior of the tank 23, which interior, apart from the oil reservoir 53, constitutes (see. FIG. 2) a fuel reservoir 66. In addition the oil pumping and fuel/oil mixing device 61 includes (see FIGS. 7 and 8) a fuel/oil mixture outlet 69 which communicates, through a conduit 71 extending through the oil reservoir 53, with the fitting 21 which is preferably located on the upper wall 43 of the combined assembly 41, which is of conventional construction, and which is adapted to be releasably connected to the fuel hose 19.

More particularly, the combined oil pumping and fuel/oil mixing device 61 comprises (see especially FIG. 3) a main housing 75 including an upper inlet-side member 77, a lower outlet-side member 79, and a movable piston or wall 81 which is located between the members 77 and 79 and which divides the main housing 75 into an inlet or high pressure chamber 83 adjacent the inlet-side member 77 and an outlet or low pressure chamber 85 adjacent the outlet-side member 79. The inlet and outlet chambers 83 and 85 inversely vary in volume in response to movement of the movable wall or piston 81. Preferably, and as shown in the drawings, the side members 77 and 79 respectively include peripheral flanges 19 which are secured in each other by screws 93 and the movable wall or piston 81 includes a flexible portion or diaphragm 95 which is peripherally sandwiched between the peripheral flanges 91 of the side members 77 and 79.

The device 61 also comprises a main biasing spring 107 which bears between the outlet-side member 79 and and the movable wall 81 and which yieldably biases the movable wall 81 in the direction minimizing the volume of the inlet chamber 83.

In order to facilitate mixing of the fuel and oil, the inlet-side member 77 includes an oil inlet port 111, and a fuel inlet port 113, both of which communicate with the inlet chamber 83. The outlet-side member 79 includes (see FIG. 8) the beforementioned fuel/oil mixture outlet 69 which communicates through the outlet-side member 79 with the outlet chamber 85, and which, as previously explained, communicates with the conduit 71 which delivers the fuel/oil mixture to the fitting 21 on the upper wall 43 of the combined assembly 41.

The oil pumping and fuel/oil mixing device 61 also comprises an oil pump housing 121 which is secured to the main housing 75 by suitable means and which includes an oil pumping chamber 125 which communicates with the oil inlet 63 through a first check valve means 127 permitting flow from the oil inlet 63 to the oil pumping chamber 125 and preventing flow from the oil pumping chamber 125 to the oil inlet 63. The oil pumping chamber 125 also communicates with an oil delivery or outlet port 129 through a second check valve means 131 which permits flow from the oil pumping chamber 125 to the delivery port 129 and which prevents flow from the delivery port 129 to the oil pumping chamber 125. The oil delivery port 129 registers with and communicates with the oil inlet port 111 in the inlet-side member 77 when the oil pump housing 121 is assembled to the main housing 75.

Located in the oil pumping chamber 125 is an oil pumping piston or member 133 which slideably extends through a suitable opening in the inlet-side member 77 and which is suitably fixed, as by a screw 135, to a valve guide member 140. Upward movement of the piston 133 causes oil to flow out of the chamber 125 into the inlet chamber 83 via the delivery portion 129 and inlet port 111. The valve guide member 140, the reason for which is explained hereinafter, is fixedly attached to the movable wall 81 for movement therewith. Thus, the oil pumping piston 133 reciprocates with the movable wall 81, and upward movement of the movable wall 81 causes oil to flow into the inlet chamber 83.

The oil pump housing 121 also includes a fuel inlet conduit 141 which has one end terminating in a fuel outlet port 143 which registers with and communicates with the fuel inlet port 113 in the inlet-side member 77 when the oil pump housing 121 is assembled to the main housing 75.

The fuel inlet conduit 141 also includes a second end terminating in a fuel inlet port 145 registering with and communicating with a fuel transfer port 147 in the outlet-side member 79 of the main housing 75. In turn, the fuel transfer port 147 communicates through a duct 149 and through a flapper valve 151 with an inlet fitting 153 which constitutes the beforementioned fuel inlet 65 and which communicates with the remainder of the tank interior which constitutes the fuel reservoir 56. If desired, and as shown in FIG. 2, the fuel inlet 65 can be attached to a filter assembly 157 which, in turn, communicates with the interior of the tank 23.

In order to afford flow of fuel and oil from the inlet chamber 83 to the outlet chamber 85, the movable wall 81 includes a generally cylindrical inner surface defining a centrally located port or passage 101 which communicates between the inlet and outlet chambers 83 and 85. The movable wall 81 also includes an upper surface partially defining the inlet chamber 83, and the passage 101 communicates with the upper surface through an opening.

The device 61 also includes a resilient member or valve seat 160 adjacent the port or passage 101. Preferably, the valve seat 160 is located on the upper surface of the wall 81 around the opening into the passage 101. The above-mentioned valve guide member 140 secures both the valve seat 160 and the diaphragm 95 to the movable wall 81. Fluid flow through the port or passage 101 is controlled by a valve member 162 which is suitably supported for movement relative to the valve seat 160 by the valve guide member 140. The valve member 162 is movable along an axis 163 (a vertical axis in the drawings) in a first or downward direction and toward the valve seat 160 to a seated position (FIGS. 3–5) for preventing fluid flow through the port or passage 101, and the valve member 162 is also movable in an opposite second or upward direction and away from the valve seat 160 to an unseated position (FIG. 6) for permitting fluid flow through the passage 101.

In order to prevent the valve member 162 from becoming "stuck" in a position (hereinafter the "equilibrium position") affording fluid flow from the inlet chamber 83 to the outlet chamber 85 at a rate which maintains the pressure differential between the chambers, the device 61 further includes means for moving the valve member 162 away from the valve seat 160 with a snap action. If the valve member 162 becomes stuck in the equilibrium position, the movable wall 81 might stop moving. This would result in continued fuel flow (the passage 101 is open), but no oil flow, because oil flow is caused by movement of the wall 81. The snap action means causes the valve member 162 to move quickly away from the valve seat 160, or with a snap action, so that the valve member 162 moves past the equilibrium position before it has a chance to become stuck in that position.

While various suitable snap action means can be employed, in the preferred embodiment, the snap action means includes a magnet 170 located, relative to the valve member 162, in the first or downward direction. In other words, the magnet 170 is located beneath the valve member 162. The magnet 170 is movable along the axis 163 and relative to the valve member 162 between a first or lower position (FIGS. 3 and 4) and a second or upper position (FIGS. 5 and 6) spaced above the first position. As shown in the drawings, the magnet 170 is preferably annular and has extending therethrough a guide member 172, the reason for which is explained hereinafter.

Figure 3:
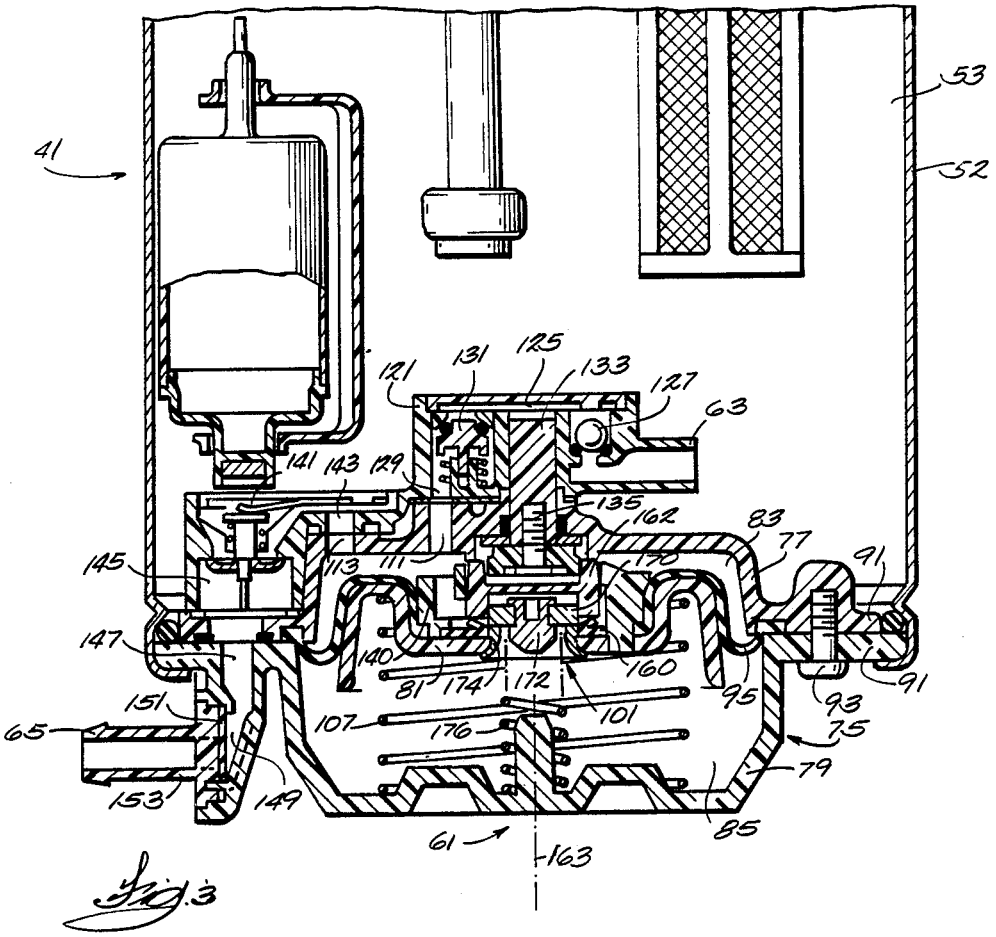
FIG. 3 is an enlarged view, partially in section, of the bottom portion of the combined oil reservoir, oil pump, and fuel/oil mixing device.

The snap action means also includes means for exerting on the magnet 170, when the valve member 162 is seated, a magnetic force biasing the magnet 170 in the first direction (or downwardly) and to the first or lower position. While various suitable means can be used, in the illustrated construction, the means for exerting the magnetic force includes a magnetically attractive member or bushing 174 mounted on the wall 81. More particularly, as shown in the drawing, the bushing 174 is annular and is mounted on the wall 81 inside the passage 101. As shown in FIG. 3, the bushing 174 extends upwardly from the wall 81 and is engaged by the magnet 170 when the magnet 170 is in the first or lower position. In order to prevent contact between the magnet 170 and the bushing 174 from acting as a valve and preventing fluid flow through the passage 101, the bushing 174 has therein a slot or slots (not shown) permitting fluid flow between the magnet 170 and the bushing 174 when the magnet 170 is in the lower position.

Figure 5:
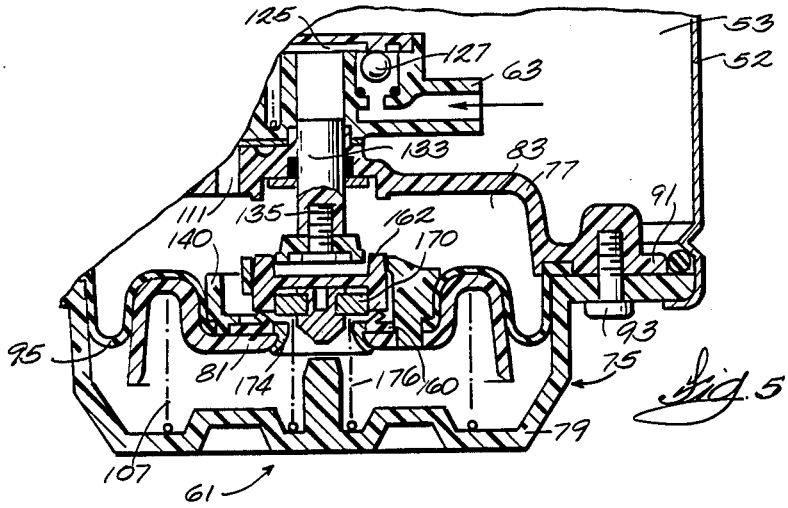
Figure 6:
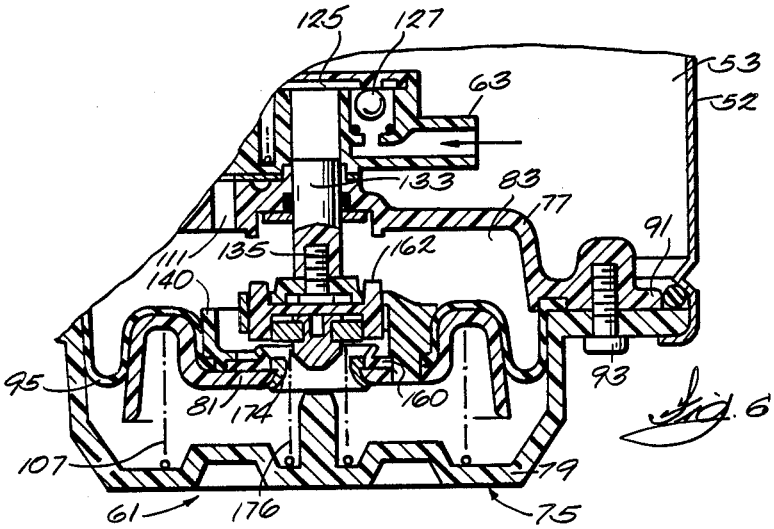

The snap action means also includes means for preventing movement of the magnet 170 in the second or upward direction beyond the second position. While various suitable means can be employed, in the preferred embodiment, such means includes the valve member 162. As shown in FIG. 5, the magnet 170 engages the underside of the valve member 162 when the magnet 170 is in the second or upper position, and thus the valve member 162 prevents the magnet 170 from moving beyond the second position.

The snap action means also includes means for exerting on the magnet 170 a second force biasing the magnet 170 in the second or upward direction. While various suitable means can be used, in the illustrated construction, the means for exerting a second force includes spring means having a variable deflection. While various suitable spring means can be employed, in the preferred embodiment, the spring means includes a compression spring 176 extending between the magnet 170 and the outlet-side member 79 of the housing 75 in the outlet chamber 85. The spring 176 is secured to the magnet 170 by the guide member 172 and is compressed in response to movement of the wall 81 in the first or downward direction, or in the direction decreasing the volume of the outlet chamber 85.

The snap action means also includes means for increasing the second force (the force exerted by the spring 176), when the valve member 162 is seated, until the second force is greater than the magnetic force. While various suitable increasing means can be used, in the illustrated construction such means includes means for increasing the deflection of the spring 176. While various suitable means can be used for increasing the deflection of the spring 176, in the preferred embodiment, such means includes the pressure differential between the inlet and outlet chambers, which pressure differential creates a force biasing the wall 81 and the valve member 162 in the first or downward direction.

Figure 4:
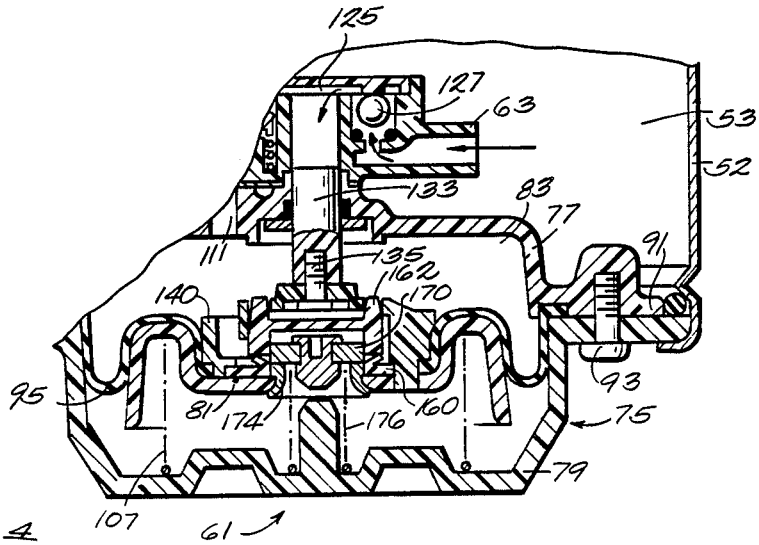
FIGS. 4, 5 and 6 are partial views similar to FIG. 3, showing the movable wall and valve member of the device in various positions.

Operation of the snap action means will now be described. Assuming that, as shown in FIG. 3, the movable wall 81 is in its uppermost position, the valve member 162 is in the seated position, and the magnet 170 is in the first or lower position against the bushing 174, suction created by the outboard motor fuel/oil mixture pump 15, acting through the fuel hose 19, the fuel/oil conduit 71 and the fuel/oil mixture outlet 69 of the housing 75, causes the mixed fuel and oil in the outlet chamber 85 to be lifted out of the outlet chamber and delivered to the carburetor 13. Outflow of fluid from the outlet chamber 85 reduces the pressure in the outlet chamber and diminishes the volume of the outlet chamber 85, thereby causing the movable wall 81 to move downwardly, thus increasing the volume of the inlet chamber 83 and causing inflow of fuel into the inlet chamber. While the inlet chamber 83 is maintained at approximately the pressure of the fuel in the tank 23 (approximately atmospheric pressure), the suction from the pump 15 causes the outlet chamber 85 to be maintained at a substantially lower pressure, thereby creating a pressure differential between the inlet and outlet chambers, which pressure differential increases as the mixture flows out of the outlet chamber 85. The pressure differential causes the valve member 162 to remain seated against the valve seat 160 during downward movement of the movable wall 81, until, as shown in FIG. 4, the movable wall 81 approaches or reaches the position minimizing the volume of the outlet chamber 85.

When the movable wall 81 reaches or approaches the position minimizing the volume of the outlet chamber 85, the spring 176 is compressed or deflected to a point where it exerts on the magnet 170 an upward force (the second force) which is greater than the magnetic force and which therefore moves the magnet 170 upwardly relative to the valve member 162 and away from the bushing 174, as shown in FIG. 5. During this upward movement of the magnet 170, the magnetic force decreases much more rapidly than the force exerted by the spring 176 (the second force). Thus, the magnet 170 actually accelerates upwardly under the influence of the spring 176. When the magnet 170 reaches its second position or engages the valve member 162 (which has remained seated due to the pressure differential between the inlet and outlet chambers), the force exerted on the magnet 170 by the spring 176 causes the valve member 162 to move upwardly or away from the valve seat 160 with a snap action.

Movement of the valve member 162 to the unseated position (see FIG. 6) permits fuel and oil flow from the inlet chamber 83 to the outlet chamber 85. This relieves the pressure differential between the inlet and outlet chambers and allows the main biasing spring 107 to move the wall 81 upwardly to minimize the volume of the inlet chamber 83. During this upward movement of the wall 81, the spring 176, acting through the magnet 170, maintains the valve member 162 in the unseated position. Also during this upward movement of the wall 81, oil flows into the inlet chamber 83, and fuel and oil flow through the passage 101 from the inlet chamber 83 to the outlet chamber 85. This fuel and oil mixture is then sucked out of the outlet chamber 83 by the pump 15, as described above. When the movable wall 81 again reaches the position minimizing the volume of the inlet chamber, as shown in FIG. 3, the valve member 162 engages the housing 75, and this causes the valve member 162 to move downwardly relative to the valve guide member 140 to the seated position. As the valve member 162 moves to the seated position, the magnetic force exerted on the magnet 170 by the bushing 174 overcomes the force exerted on the magnet 170 by the spring 176 and moves the magnet 170 to the first or lower position against the bushing 174.

Because the magnet 170 is spaced beneath the valve member 162 when the valve member 162 is seated, the force exerted by the sprign 176 acts only on the magnet 170 and does not oppose the pressure differential seating the valve member 162. Therefore, the full pressure differential between the inlet and outlet chambers 83 and 85 is available for seating the valve member 162.

Additionally, because the magnetic force and the force exerted by the spring 176 determine when the valve member 162 is unseated, opening of the passage 101 depends only on the position of the movable wall 81 (this determines the force exerted by the spring 176) and not on the pressure differential between the inlet and outlet chambers 83 and 85.

Furthermore, the snap action means does not have severe dimensional tolerance requirements. This is important because plastic components will often swell when exposed to fuel, which may contain alcohol.

Since movement of the movable wall 81 causes corresponding movement of the oil pumping piston member 133 in the oil pumping chamber 125, oil is supplied to the inlet chamber 83 is fixed predetermined relation to the amount of fuel passing through the main housing 75. Thus, the engine is automatically supplied with a fuel-/oil mixture of the proper ratio from the separate oil and fuel reservoirs 53 and 66, respectively.

In the preferred embodiment, the device 61 further comprises magnetic means operative when the valve member 162 is spaced from the valve seat 160 for releasably retaining the valve member in the unseated position. During upward movement of the movable wall 81, this magnetic means assists the spring 176 in retaining the valve member 162 away from the valve seat 160. While various suitable magnetic means can be employed, in the preferred embodiment, the magnetic means includes the magnet 176, the magnet 176 being attracted to the metal screw 135 securing the oil pumping piston 133 to the valve guide member 140.

Various of the features of the invention are set forth in the following claims.

I claim:

1. An oil storing, oil pumping, and fuel/oil mixing assembly comprising an upper wall having therein an opening which is adapted to afford filling of oil into said assembly, an endless wall depending from said upper wall to partially define an oil reservoir communicating with said opening, and an oil pumping and fuel/oil mixing device secured to said depending wall to form the bottom of said oil reservoir, said device including a housing, a movable wall dividing said housing into inlet and outlet chambers adapted to have a pressure differential therebetween, said wall having therethrough a passage communicating between said inlet and said outlet chambers, said device further including a first inlet communicating between said inlet chamber and said oil reservoir, a second inlet communicating with said inlet chamber and adapted to communicate with a fuel source, an outlet communicating with said outlet chamber for delivering the fuel/oil mixture, a valve seat adjacent said passage, a valve member movable along an axis in a first direction and toward said valve seat to a seated position for preventing fluid flow through said passage, and said valve member being movable in an opposite second direction and away from said valve seat to an unseated position for permitting fluid flow through said passage, and means for moving said valve member away from said valve seat with a snap action and including a magnet located, relative to said valve member, in said first direction, said magnet being movable along said axis and relative to said valve member between a first position and a second position spaced in said second direction from said first position, means for exerting on said magnet, when said valve member is seated, a magnetic force biasing said magnet in said first direction and to said first position, means for preventing movement of said magnet in said second direction beyond said second position, means for exerting on said magnet a second force biasing said magnet in said second direction, and means for increasing said second force, when said valve member is seated, until said second force is greater than said magnetic force.

2. An assembly as set forth in claim 1 wherein said means for exerting a second force includes spring means having a variable deflection, and wherein said increasing means includes means for increasing the deflection of said spring means.

3. An assembly as set forth in claim 1 wherein said wall is movable within said housing for varying the volumes of said inlet and outlet chambers, wherein movement of said wall in said first direction decreases the volume of said outlet chamber, and wherein said means for exerting on said magnet a second biasing force includes a compresion spring extending between said housing and said valve member in said outlet chamber, said spring being compressed in response to movement of said wall in said first direction.

4. An assembly as set forth in claim 3 wherein the pressure differential between said inlet and outlet chambers creates a force biasing said wall in said first direction, and wherein said means for increasing the deflection of said spring means includes the pressure differential.

5. An assembly as set forth in claim 1 wherein said means for exerting said magnetic force includes a magnetically attractive member mounted on said wall.

6. An assembly as set forth in claim 1 wherein said means for preventing movement includes said valve member.

7. An assembly as set forth in claim 1 wherein the pressure differential between said inlet and outlet chambers biases said valve member in said first direction.

8. An assembly as set forth in claim 1 wherein said housing includes an inlet-side member and an outlet-side member, and wherein said movable wall is located between said inlet-side member and said outlet-side member.

9. An assembly as set forth in claim 1 wherein said wall includes a surface, wherein said passage communicates with said surface through an opening, and wherein said valve seat is located on said surface around said opening.

10. A valve assembly comprising a wall having therein a passage, a valve seat adjacent said passage, a valve member movable along an axis in a first direction and toward said valve seat to a seated position for preventing fluid flow through said passage, and said valve member being movable in an opposite second direction and away from said valve seat to an unseated position for permitting fluid flow through said passage, and means for moving said valve member away from said valve seat with a snap action and including a magnet located, relative to said valve member, in said first direction, said magnet being movable along said axis and relative to said valve member between a first position and a second position spaced in said second direction from said first position, means for exerting on said magnet, when said valve member is seated, a magnetic force biasing said magnet in said first direction and to said first position, means for preventing movement of said magnet in said second direction beyond said second position, means for exerting on said magnet a second force biasing said magnet in said second direction, and means for increasing said second force, when said valve member is seated, until said second force is greater than said magnetic force.

11. An assembly as set forth in claim 10 wherein said means for exerting a second force includes spring means having a variable deflection, and wherein said increasing means includes means for increasing the deflection of said spring means.

12. A valve assembly as set forth in claim 10 wherein said means for exerting said magnetic force biases said magnet toward a first position relative to said valve member, wherein said valve member prevents movement of said magnet in said second direction beyond a second position relative to said valve member, said second position being spaced in said second direction from said first position, and wherein said magnet moves from said first position to said second position when said second force exceeds said magnetic force.

13. An assembly as set forth in claim 10 wherein said wall includes a surface, wherein said passage communicates with said surface through an opening, and wherein said valve seat is located on said surface around said opening.

14. An assembly as set forth in claim 10 wherein said means for exerting said magnetic force includes a magnetically attractive member mounted on said wall.

15. An assembly as set forth in claim 10 wherein said means for preventing movement includes said valve member.

16. An assembly as set forth in claim 10 and further comprising means for biasing said valve member in said first direction.

17. An apparatus comprising a hosuing, a wall dividing said hosuing into high and low pressure chambers adapted to have a pressure differential therebetween, said wall having therethrough a passage communicating between said high and low pressure chambers, a valve seat adjacent said passage, a valve member movable along an axis in a first direction and toward said valve seat to a seated position for preventing fluid flow through said passage, and said valve member being movable in an opposite second direction and away from said valve seat to an unseated position for permitting fluid flow through said passage, and means for moving said valve member away from said valve seat with a snap action and including a magnet located, relative to said valve member, in said first direction, said magnet being movable along said axis and relative to said valve member between a first position and a second position spaced in said second direction from said first position, means for exerting on said magnet, when said valve membr is seated, a magnetic force biasing said magnet in said first direction and to said first position, means for preventing movement of said magnet in said second direction beyond said second position, means for exerting on said magnet a second force biasing said magnet in said second direction, and means for increasing said second force, when said valve member is seated, until said second force is greater than said magnetic force.

18. An apparatus as set forth in claim 17 wherein said means for exerting a second force includes spring means having a variable deflection, and wherein said increasing means includes means for increasing the deflection of said spring means.

19. An apparatus as set forth in claim 17 wherein said means for exerting said magnetic force biases said magnet toward a first position relative to said valve member, wherein said valve member prevents movement of said magnet in said second direction beyond a second position relative to said valve member, said second position being spaced in said second direction from said first position, and wherein said magnet moves from said first position to said second position when said second force exceeds said magnetic force.

20. An apparatus as set forth in claim 17 wherein said wall includes a surface, wherein said passage communicates with said surface through an opening, and wherein said valve seat is located on said surface around said opening.

21. An apparatus as set forth in claim 17 wherein said wall is movable within said housing for varying the volumes of said high and low pressure chambers, wherein movement of said wall in said first direction decreases the volume of said low pressure chamber, and wherein said spring means includes a compression spring extending between said housing and said valve member in said low pressure chamber, said spring being compressed in response to movement of said wall in said first direction.

22. An apparatus as set forth in claim 17 wherein the pressure differential between said chambers creates a force biasing said wall in said first direction, and wherein said means for increasing the deflection of said means exerting on said magnet a second biasing force includes the pressure differential.

23. An apparatus as set forth in claim 17 wherein said means for exerting said magnetic force includes a magnetically attractive member mounted on said wall.

24. An apparatus as set forth in claim 17 wherein said means for preventing movement includes said valve member.

25. An apparatus as set forth in claim 17 wherein the pressure differential between said chambers biases said valve member in said first direction.

* * * * *